US007114977B2

(12) United States Patent
Lei et al.

(10) Patent No.: US 7,114,977 B2
(45) Date of Patent: Oct. 3, 2006

(54) SOCKET CONNECTOR WITH ANTI-ROTATION DEVICE

(75) Inventors: Jinfeng Lei, Kunsan (CN); Wei Yu, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 0 days.

(21) Appl. No.: 11/025,646

(22) Filed: Dec. 28, 2004

(65) Prior Publication Data

US 2005/0196989 A1 Sep. 8, 2005

(51) Int. Cl.
*H01R 4/50* (2006.01)
*H01R 13/625* (2006.01)

(52) U.S. Cl. ..... 439/342

(58) Field of Classification Search ..... 439/342, 439/343, 262–264, 268, 331, 923
See application file for complete search history.

(56) References Cited

U.S. PATENT DOCUMENTS 6,254,415 B1 7/2001 Mizumural et al.
6,338,640 B1 * 1/2002 Lin ..... 439/342
6,579,112 B1 * 6/2003 Nobuyuki et al. ..... 439/342
6,676,431 B1 * 1/2004 Kukita et al. ..... 439/342
6,712,634 B1 * 3/2004 McClinton ..... 439/342
6,910,908 B1 * 6/2005 Tran et al. ..... 439/342

* cited by examiner

*Primary Examiner*—Hae Moon Hyeon
(74) *Attorney, Agent, or Firm*—Wei Te Chung

(57) ABSTRACT

A socket connector (1) includes a base (2), a cover (3) slidably mounted on the base, and an actuator (4) for actuating the cover to slide on the base between a pin insert position and a second engagement position. The base comprises a mainbody (21) and a fixing portion (22) in front of the mainbody. The mainbody defines a plurality of passageways receiving a plurality of terminals therein, and the fixing portion has blocks thereon. The cover comprises a body portion (31) and a header portion (32) in front of the body portion. The body portion defines a plurality of through holes provided in a one-to-one corresponding relationship with the passageways of the underlying base. The header portion is fitly fixed on the fixing portion of the base and engaging with the blocks thereof for preventing the cover from sideways rotation moving.

17 Claims, 2 Drawing Sheets

SOCKET CONNECTOR WITH ANTI-ROTATION DEVICE

BACKGROUND OF THE INVENTION

1. Field of the Invention

The present invention relates to a socket connector for electrically connecting a central processing unit (CPU) with a printed circuit board (PCB), and particularly to a socket connector with anti-rotation device.

2. Description of Related Art

A socket connector which is widely used in personal computer (PC) systems to electrically connect CPU with PCB usually comprises a base, a cover, and an actuator. The cover is movably mounted on an upper surface of the base. The actuator is a cam comprising at least two cylindrical portions, central axes of which are offset from each other. One of the cylindrical portions interferes with the base and another interferes with the cover. Then, by rotation of the actuator, the cam axe moves to push or pull the cover to slide relative to the base, along an anticipative front-to-back direction, between a pin insert position and a pin engagement position. However, when the actuator is rotated to drive the cover to slide along the front-to-back direction, it may cause the cover to rotate together with it, result in a sideways movement of the cover relative to the base. When this happens, the cover may slide improperly or even may fail to slide.

To overcome above-motioned problems, a new socket connector with anti-rotation device is desired.

SUMMARY OF THE INVENTION

An object of the present invention is to provide a socket connector with anti-rotation device for preventing its cover from rotating relative to its base.

Accordingly, to achieve the above object, a socket connector of present invention includes a base, a cover slidably mounted on the base, and an actuator for actuating the cover to slide on the base between a pin insert position and a second engagement position. The base comprises a mainbody and a fixing portion in front of the mainbody. The mainbody defines a plurality of passageways receiving a plurality of terminals therein, and the fixing portion has blocking means thereon. The cover comprises a body portion and a header portion in front of the body portion. The body portion defines a plurality of through holes provided in a one-to-one corresponding relationship with the passageways of the underlying base. The header portion is fitly fixed on the fixing portion of the base and engaging with the blocking means thereof for preventing the cover from sideways rotation moving.

Other objects, advantages and novel features of the present invention will become more apparent from the following detailed description of the present embodiment when taken in conjunction with the accompanying drawings.

DETAILED DESCRIPTION OF THE INVENTION

Figure 1:
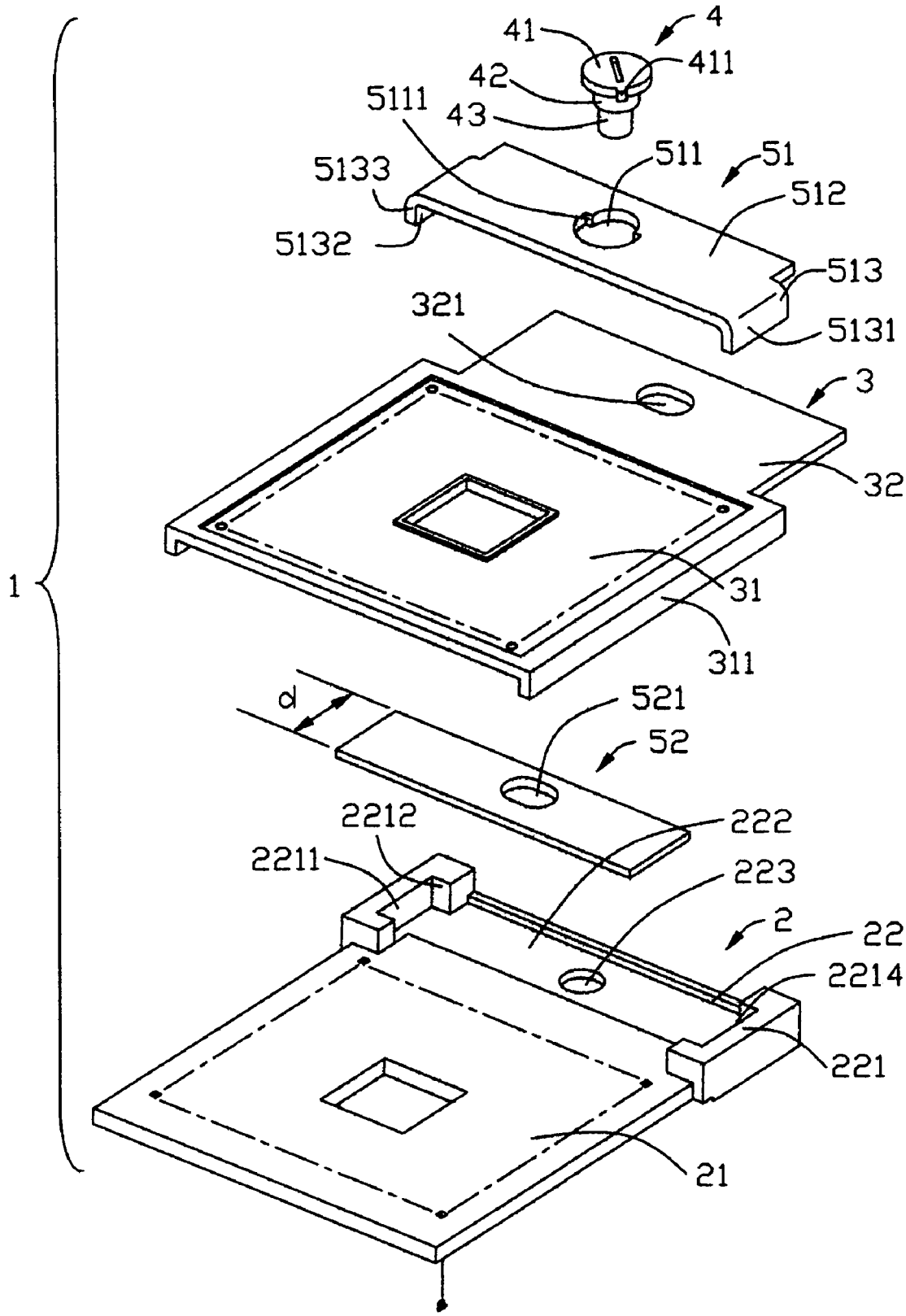
FIG. 1 is a simplified exploded view of a socket connector in accordance with a preferred embodiment of the present invention.

Reference will now be made to the drawing figures to describe the present invention in detail.

Referring to FIG 1, an socket connector 1 in accordance with a preferred embodiment of the present invention comprises a base 2, a cover 3 slidably engaged on the base 2.

The base 2 which is generally rectangular comprises a mainbody 21 and a fixing portion 22 in front of the mainbody 21. The mainbody 21 has a plurality of terminal-receiving passageways (not labeled) therein. Each passageway has a terminal (not shown) press-fit therein from its bottom side. The fixing portion 22 comprises a pair of blocks 221 respectively protruding upwards at its two opposite lateral sides and a recess 222 defined therebetween. Each block 221 comprises a restricting sidewall 2211 and two opposite end wall 2212 perpendicularly extending from two ends of the sidewall 2211 respectively, which defines a cutout 2214 therebetween communicating with the recess 222. The two cutouts 2214 oppositely open to each other while each opens upwards. A first hole 223 is defined in a length-middle of the fixing portion 22 and communicates with the recess 222 for receiving an actuator 4.

The cover 3 comprises a body portion 31 and a header portion 32 in front of the body portion 31. The body portion 31 has a pair of lateral flanges 311 extending down vertically by its two sides, and defines a plurality of through holes (not labeled) provided in a one-to-one corresponding relationship with the passageways of the underlying base 2. The header portion 32 has a size fitting for being received in the recess 222 between the two blocks 221, and defines a second hole 321 corresponding to the first hole 223 for receiving the actuator 4.

The cover 3 further comprises a cover plate 52 for being insert-molded onto an under surface of the header portion 32 of the cover 3. The cover plate defines a third hole 521 corresponding to the first hole 223 and the second hole 321 for receiving the actuator 4.

The base 2 further comprises a base bottom plate (not shown) and a base top plate 51. The base bottom plate is for mounted onto an under surface of the base 2. The base top plate 51 comprises a plate portion 512 and a pair of wing portions 513 extending downwards from two opposite ends of the plate portion 512. Each wing portion 513 has an outer face 5131, an inner face 5132, and two opposite end faces 5133. A fourth hole 511 is defined in the middle of the plate portion 512 corresponding to the first hole 223, the second hole 321 and the third hole 521 for receiving the actuator 4. The fourth hole 511 comprises a semicircular portion, and a contiguous segment-shaped portion. A radius of the semicircular portion is greater than a radius of the segment-shaped portion. Accordingly, a pair of spaced stop walls 5111 is formed at the junction of the semicircular portion and the segment-shaped portion.

The actuator 4 comprises a top cylindrical portion 41, a middle cylindrical portion 42 and a low cylindrical portion 43 formed one on the other. The cylindrical portions progressively decrease in diameter from top to bottom. Central axes of the top cylindrical portion and the low cylindrical portion are in-line, but the middle cylindrical portion is offset. A lateral protrusion 411 protrudes from a circumferential periphery of the top cylindrical portion.

Figure 2:
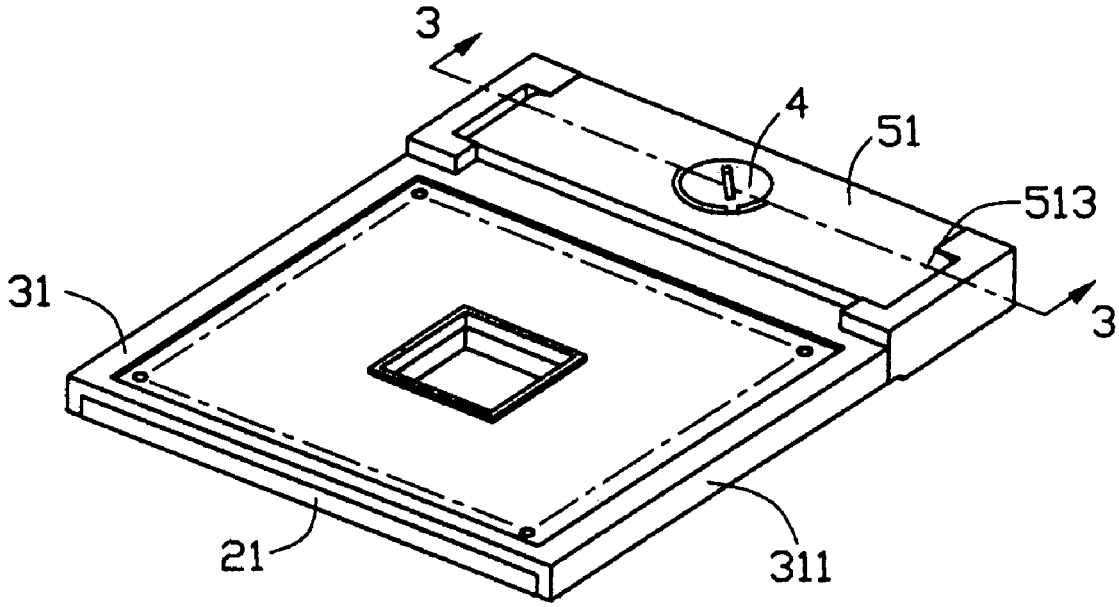
FIG. 2 is a assembled perspective view of the socket connector of FIG. 1.
Figure 3:
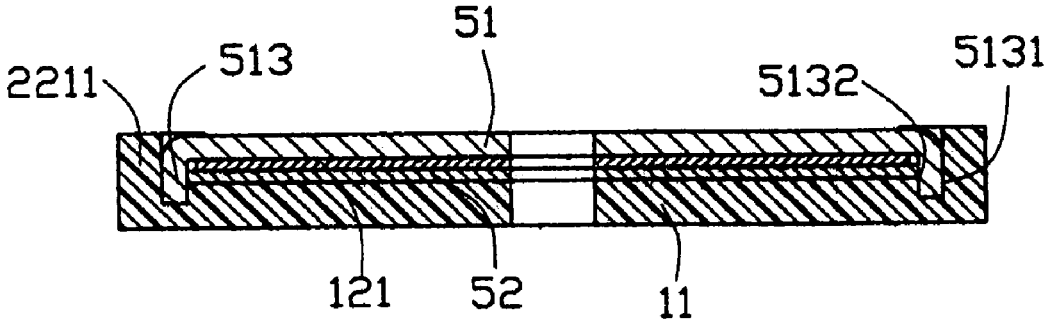
FIG. 3 is a cross-sectional view of the socket connector taken along line 3—3 of FIG. 2, in which a cam actuator has been removed.

Referring to FIGS. 2 and 3, in assembly, the cover plate 52 which is made from a metal material is insert-molded onto the under surface of the header portion 32 of the cover 3 to engage with the actuator 4 to drive the cover 3 to slide, thus prevents the cover 3 that made of a plastic material from engaging directly with the actuator 4, which may result in abrasion of the cover 3. Then the cover 3 with the cover plate 52 on is mounted onto the base 2 while its header portion 32 being received in the recess 222, two ends of the cover plate 52 laterally extending into the two cutouts 2214 respectively, and the lateral flanges 311 of its body portion 31 respectively fastening two opposite sides of the base 2. A width (d) of the cover plate 52 is smaller than a width of the cutout 2214 that is a distance between inside faces of the two end walls 2212 of the block 221, thus ensures that the cover plate 52 can move in a front-to-back direction in the cutout 2214 to drive the cover 3 slide on the base 2 between a pin insert position at which pins of a CPU are inserted into the through holes of the cover 3 with Zero Insertion Force and a second engagement position at which then pins of the CPU in the through holes of the cover 3 engage the terminals in the base 2. The base top plate 51 is covered on the header portion 32 of the cover 3 with its two wing portions 513 forcibly inserted into respective cutout 2214 till partially embedded in the plastic base 2, while the outer face 5131 abutting on the restricting sidewall 2211, the inner face 5132 abutting on the end of the cover plate 52. Thus, in assembly, the wing portion 513 received in the cutout 2214, functions as a complementary interengaging means complementing the space between the header portion 32 and the block 221 of the fixing portion, and interengaging with the lateral edge of the header portion 32 for preventing it from laterally moving. An upper surface of the plate portion 512 of the base top plate 51 is flush with upper surfaces of the two blocks.

The actuator 4 is sequentially extended through the fourth hole 511, the third holes 321, second hole 521, first hole 223, and corresponding hole in the base bottom plate, and then is riveted with a washer (not shown) to be secured in the socket connector 1. Thus the base bottom plate, the base 2, the cover plate 51, the cover 3, the base top plate 52, and the actuator 4 are assembled together. Rotation of the actuator 4 is restricted between a position where the block 41 of the actuator 4 abuts against one of the stop walls 5111 of the fourth hole 511 in the base top plate 51, and a position where the block 41 abuts against the other stop wall 5111. Thus a distance that the cover 12 can slide is limited.

According to above-mentioned configuration, when the actuator 4 drives the cover 3 to slide on the base 2 between the pin insert position and the pin engagement position via the cover plate 52, the blocks 221 of the base 2 and the wing portions 513 of the base top plate 51 respectively restrict sideways movement of the cover 3 and the cover plate 52. Meanwhile, because the base top plate 51 is fastened to the base, and the low cylindrical portion 43 and the top cylindrical portion 41 are interferingly received in the base 2 and the base top plate 51 respectively, so that the rotation of the low cylindrical portion 43 and the top cylindrical portion 41 are restricted, thus rotation movement of the cover 3 together with the actuator 4 is minimized in some sense. Thereby, with such a design, the possible sideways rotation movement of the cover 3 is avoided or at least minimized, that ensures proper and efficient engagement between the pins inserted in the cover 3 and the terminals in the base 2.

The disclosure is illustrative only, changes maybe made in detail, especially in matter of shape, size, and arrangement of parts within the principles of the invention. For example, the base top plate 51 can be retained to the base 2 by agnail protruding from its wing portions 513.

What is claimed is:

1. A socket connector comprising:

a base comprising a mainbody and a fixing portion in front of the mainbody, the mainbody defining a plurality of passageways receiving a plurality of terminals therein, the fixing portion having blocking means thereon;

a cover slidably mounted on the base and comprising a body portion and a header portion in front of the body portion, the body portion defining a plurality of through holes corresponding to the passageways of the base, the header portion being fitted on the fixing portion of the base and engaging with the blocking means for preventing the cover from sidewardly rotating;

a base top plate assembled to the base; and an actuator for actuating the cover to slide on the base.

2. The socket connector as described in claim 1, wherein the body portion of the cover has a pair of lateral flanges extending downwardly from two sides thereof and fastening against two opposite sides of the base respectively.

3. The socket connector as described in claim 1, wherein the cover comprises a cover plate insert-molded onto the cover for engaging with the actuator to drive the cover to slide on the base.

4. The socket connector as described in claim 3, wherein the blocking means comprises a pair of blocks respectively protruding upwards from two opposite lateral sides of the fixing portion, and defining a recess therebetween for fixably receiving the header portion of the cover.

5. The socket connector as described in claim 4, wherein the pair of blocks each defines a cutout communicating with the recess, the two cutout oppositely opening to each other while each opening upwards.

6. The socket connector as described in claim 5, wherein the cover plate is flat strip and is received in the recess while its two ends laterally extending into the two cutouts respectively, and the cover plate is allowed to move along a front-to-back direction in the cutout.

7. The socket connector as described in claim 1, wherein the base and the base top plate define a space therebetween for receiving the header portion of the cover.

8. The socket connector as described in claim 7, wherein the base top plate comprises a plate portion and a pair of wing portions respectively extending downwards from two ends of the plate portion, and wherein the base cop plate is fastened to the base by interference between the wing portions and the base.

9. The socket connector as described in claim 1, wherein the base comprises a base bottom plate mounted onto an under surface of the base.

10. A socket connector comprising:

a base defining a first main body and a first head portion;

a plurality of passageways defined in the first main body;

a plurality of terminals disposed in the corresponding passageways, respectively;

a cover mounted upon the base and moveable along a front-to-back direction relative to the base, and defining a second main body and a second head portion in alignment with the first main body and the first head portion, respectively;

a plurality of through holes formed in the second main body in alignment with the corresponding passageways, respectively;

complementary interengaging means formed between the first head portion and the second head portion to prevent the second head portion from laterally moving relative to the first head portion; and an actuator disposed in both said first head portion and said second head portion and being rotatable about a vertical axis to drive the cover to move in said front-to-back direction relative to the base.

11. The socket connector as claimed in claim 10, wherein the first head portion forms a raised block abutting against the second head portion laterally.

12. The socket connector as claimed in claim 10, wherein the first head portion forms a raised block, and the complementary interengaging means is sandwiched between the raised block and a lateral edge of the second head portion.

13. The socket connector as claimed in claim 10, wherein the complementary interengaging means is made from metal material.

14. A socket connector comprising:

a base defining a first main body and a first head portion;

a plurality of passageways defined in the first main body;

a plurality of terminals disposed in the corresponding passageways, respectively;

a cover mounted upon the base and moveable along a front-to-back direction relative to the base, and defining a second main body and a second head portion in alignment with the first main body and the first head portion, respectively;

a plurality of through holes formed in the second main body in alignment with the corresponding passageways, respectively;

an actuator disposed in both said first head portion and second head portion and being rotatable about a vertical axis to drive the cover to move in said front-to-back direction relative to the base;

and a top plate fixed to and positioned above the first head portion; wherein said top plate cooperates with the first head portion to sandwich the second head portion therebetween.

15. The socket as claimed in claim 14, wherein the top plate defines a through hole through which the actuator extends.

16. The socket as claimed in claim 15, wherein a protrusion is formed on the actuator and in the through hole for determining rotation range of said actuator.

17. The socket connector as claimed in claim 14, wherein the first head portion forms a raised block abutting against the second head portion laterally.

* * * * *